US005913473A

United States Patent [19]

Wang

[11] Patent Number: 5,913,473

[45] Date of Patent: Jun. 22, 1999

[54] STRUCTURE OF DETACHABLE STORAGE BOX

[76] Inventor: Wen-Tsan Wang, P.O. Box 82-144, Taipei, Taiwan

[21] Appl. No.: 09/009,419

[22] Filed: Jan. 20, 1998

[51] Int. Cl.[6] ..... B65D 25/04

[52] U.S. Cl. ..... 229/120.07; 229/120.23; 229/120.33; 229/120.35

[58] Field of Search ..... 229/120.07, 120.22, 229/120.23, 120.24, 120.25, 120.26, 120.31, 120.33, 120.35, 120.37, 198, 198.1, 198.2, 198.3; 220/507, 510, 529

[56] References Cited

U.S. PATENT DOCUMENTS

| | | | |
|---|---|---|---|
| 1,140,741 | 5/1915 | Grunow, Jr. | 229/120.22 |
| 3,051,345 | 8/1962 | Flynn | 229/120.23 |
| 3,101,652 | 8/1963 | Imielinski | 229/120.31 |
| 3,189,074 | 6/1965 | Schaefer | 229/120.22 |
| 3,201,022 | 8/1965 | Glassco et al. | 229/120.24 |
| 3,217,771 | 11/1965 | Skirow et al. | 229/120.22 |
| 3,306,513 | 2/1967 | Fishman | 229/120.31 |
| 4,094,454 | 6/1978 | Snyder | 229/120.33 |
| 4,144,995 | 3/1979 | Travis | 229/120.26 |
| 4,499,997 | 2/1985 | Swingley, Jr. | 220/510 |
| 4,948,039 | 8/1990 | Amatangelo | 229/198 |
| 4,979,657 | 12/1990 | Espiritu | 229/198 |
| 5,474,204 | 12/1995 | Sutyla | 220/507 |

*Primary Examiner*—Gary E. Elkins
*Attorney, Agent, or Firm*—A & J

[57] ABSTRACT

A detachable storage box including a box body formed by folding up a sheet element and securing it into shape by hook and loop materials, the box body having female fastening elements at front panel, back panel and two opposite side panels thereof at an inner side, and a partition device mounted inside the box body to divide the box body into a plurality of separated open spaces for keeping small items, the partition device including a plurality of cardboard sheets with transverse folding lines for folding into corrugated condition, split bolts and retainer rings for fastening to mounting holes on the cardboard sheets to secure the cardboard sheets into a lattice structure, the cardboard sheets having male fastening elements for securing to the female fastening elements at the box body.

3 Claims, 3 Drawing Sheets

STRUCTURE OF DETACHABLE STORAGE BOX

BACKGROUND OF THE INVENTION

The present invention relates to a detachable storage box for keeping personal small items, and more particularly to such a detachable storage box which is comprised of a collapsible box body, and a partition device fastened to the inside of the box body to divide the inside space of the box body into a plurality of storage compartments.

U.S. pat. application Ser. No. 08/764,294 discloses a detachable storage box for keeping personal small items, which is now a patent. This structure of storage box is comprised of a box body, and a collapsible lattice type partition device mounted inside the box body and defining a plurality of separated open spaces for keeping small items. The box body is formed by folding up a sheet element, which is comprised of a bottom panel, a front panel, a back panel, a top panel and two side panels. After the sheet element is folded up, it is secured in shape by hook and loop materials. The collapsible lattice type partition device has female fastening elements respectively fastened to respective male fastening elements inside the box body. This storage box is functional. However, because the collapsible lattice type partition device is comprised of a plurality of flexible sheet elements connected in parallel into a lattice structure, the flexible sheet elements tend to be forced to deform, causing storage items to fall down in the open spaces defined within the collapsible lattice type partition device.

SUMMARY OF THE INVENTION

The invention eliminates the aforesaid disadvantage. According to the present invention, the partition device is comprised of a plurality of cardboard sheets with transverse folding lines for folding into corrugated condition, split bolts and retainer rings for fastening to mounting holes on the cardboard sheets to secure the cardboard sheets into a lattice structure. The cardboard sheets are provided with male fastening elements for securing to respective female fastening elements at the box body. Further, the cardboard sheets are laminated with plastic films to reinforce its structural strength.

DETAILED DESCRIPTION OF THE PREFERRED EMBODIMENT

Figure 1:
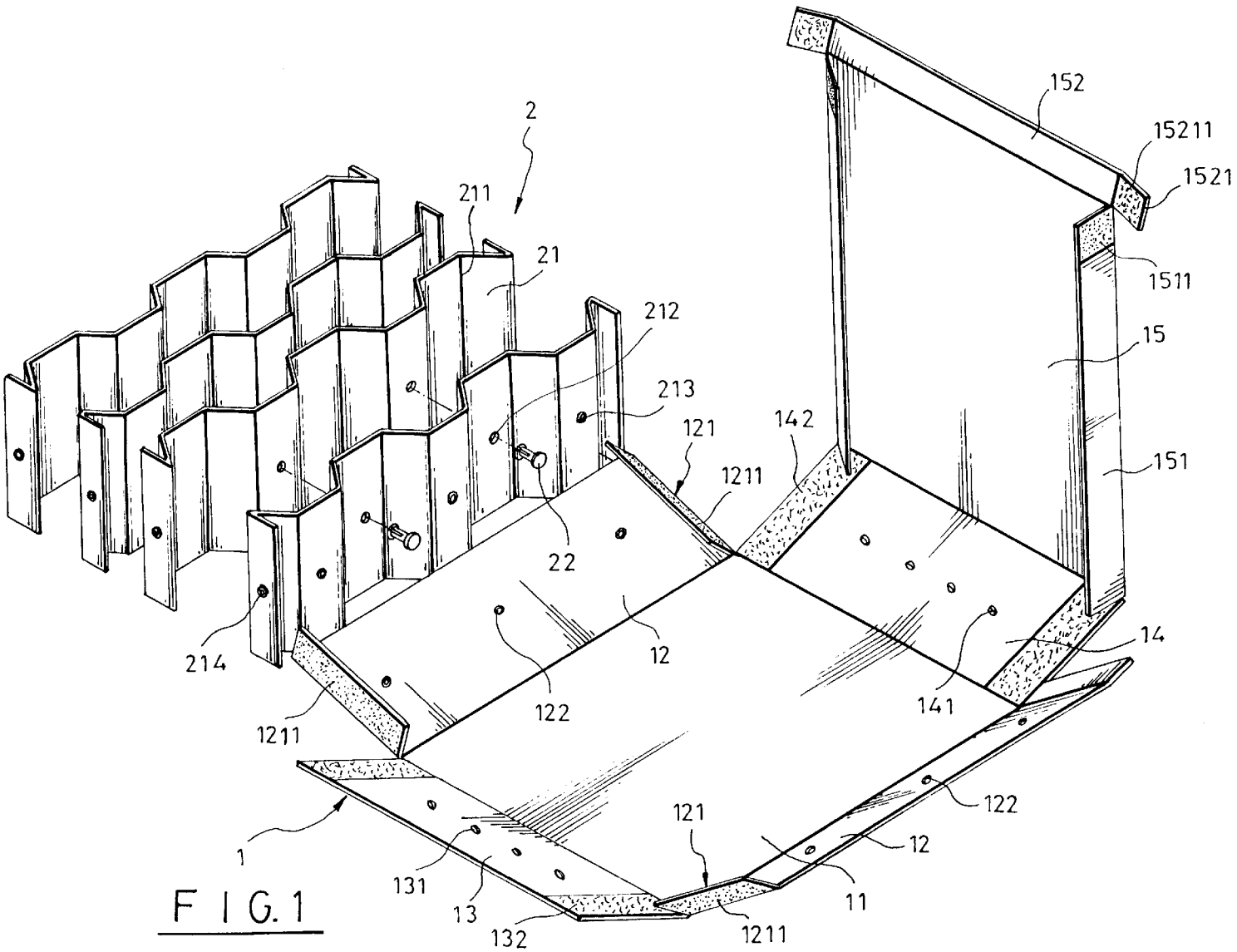
FIG. 1 is an exploded view of a collapsible storage box according to the present invention.
Figure 2:
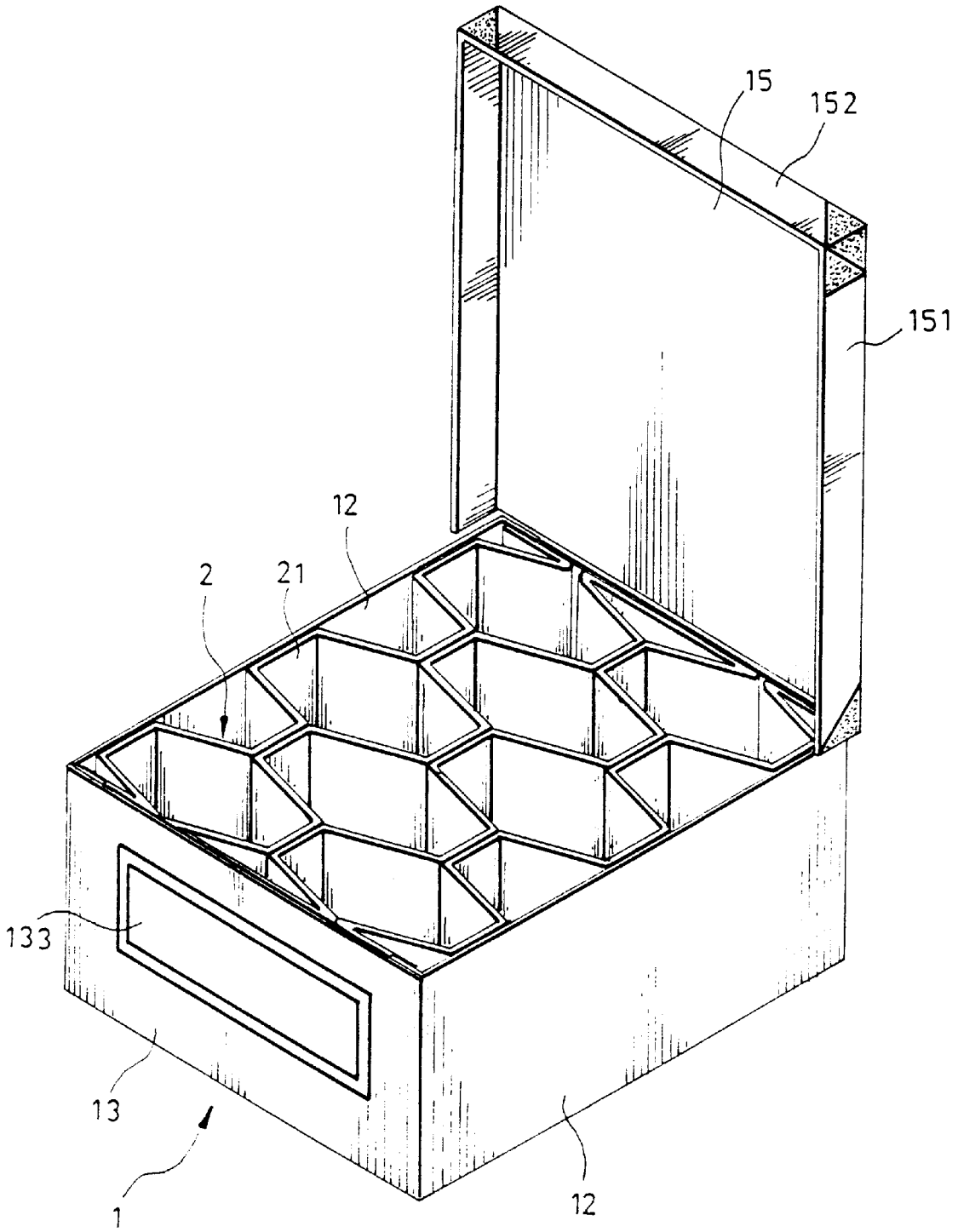
FIG. 2 is a perspective view of the present invention showing the top panel of the box body opened.

Referring to FIGS. 1 and 2, a detachable storage box in accordance with the present invention is generally comprised of a box body 1, and a partition device 2 mounted inside the box body 1.

Figure 3:
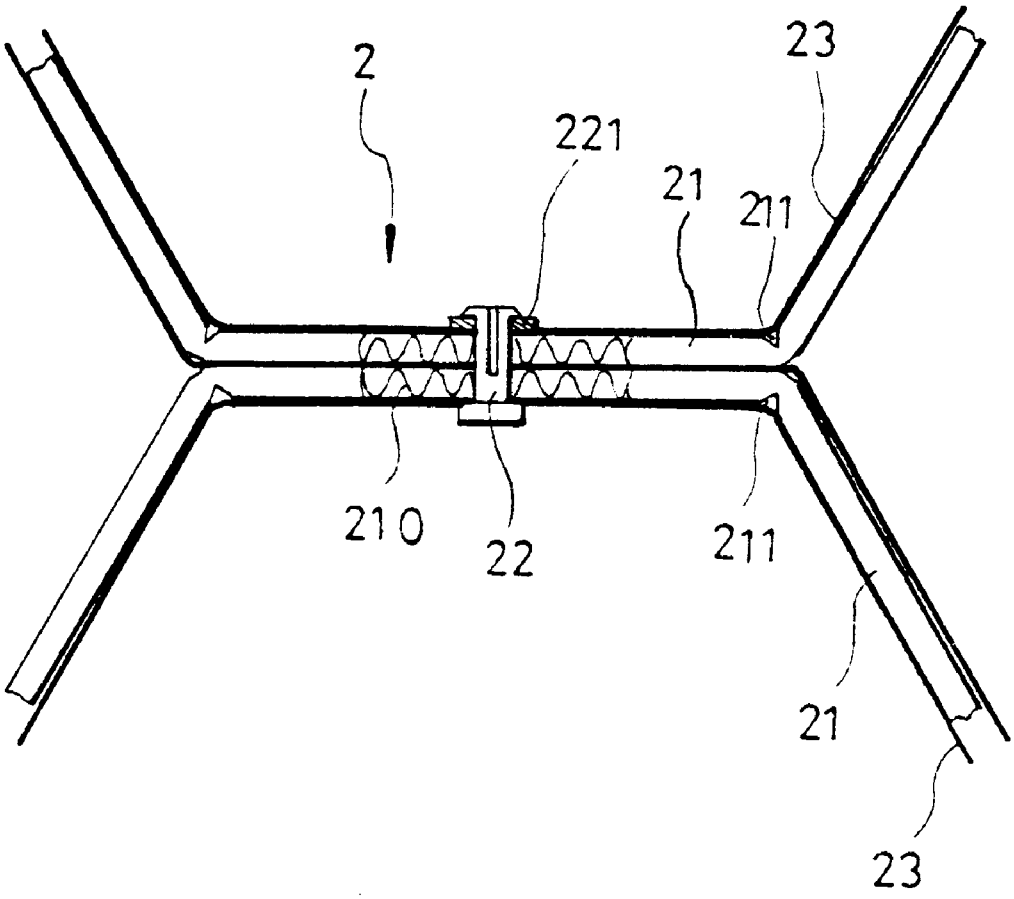
FIG. 3 is a sectional view of a part of the partition device according to the present invention.

Referring to FIGS. 1 and 2 again, the box body 1 is made by folding up a sheet element into shape, comprising a rectangular bottom panel 11 having a front side and a rear side and two opposite lateral sides, a front panel 13 and a back panel 14 respectively extended from the front and rear sides of the rectangular bottom panel 11, two side panels 12 respectively extended from the two opposite lateral sides of the bottom panel 11, and a top panel 15 extended from one side of the back panel 14 remote from the bottom panel 11. The front panel 13 and back panel 14 have respective hook tapes 132, 142 bilaterally disposed at an inner side, and respective female fastening elements (socket sides of snaps) 131, 141 disposed at an inner side between the hook tapes 132, 142. The front panel 13 has an index window 133 at an outer side (see FIG. 3) for holding an index card. Each side panel 12 comprises two opposite side flaps 121, and a plurality of female fastening elements (socket sides of snaps) 122 at an inner side between the side flaps 121. Each side flap 121 has a loop tape 1211 at an outer side. The top panel 15 comprises two side flaps 151 at two opposite lateral sides thereof, and a front flap 152 at a front side thereof remote from the back panel 14. Each side flap 151 has a loop tape 1511 at an outer side at one end adjacent to the front flap 152. The front flap 152 comprises two end flap sections 1521, and two hook tapes 15211 respectively disposed at the end flap sections 1521 at an inner side.

Referring to FIG. 2 and FIGS. 1 and 2 again, the partition device 2 is comprised of a plurality of cardboard sheets 21 connected into a lattice structure. Both sides of each cardboard 21 are respectively laminated with a flexible film material for example a plastic film 23. Each cardboard 21 has a plurality of transverse folding lines 211, a plurality of longitudinally spaced mounting holes 212, and a male fastening element (ball side of a snap) 22 at each of its both ends for fastening to the female fastening elements (socket sides of snaps) 131;141 at the front panel 13 and the back panel 14. Through the transverse folding lines 211, the cardboard sheets 21 can be folded into corrugated boards, and then fastened together to form a lattice structure. The mounting holes 212 on one cardboard 21 are fastened to the mounting holes 212 on another by split bolts 22 and retainer rings 221 (see FIG. 3). Further, male fastening elements (ball sides of snaps) 213 are provided at the two outer cardboard sheets 21 of the partition device 2 for fastening to the female fastening elements (socket sides of snaps) 122 at the side panels 12 of the body 1.

Referring to FIGS. from 1 to 3 again, the side panels 12 are inwardly folded up, then the side flaps 121 of each side panel 12 are respectively and inwardly folded up, and then the front panel 13 and the back panel 14 are inwardly folded up, and then the hook tapes 132 of the front panel 13 and the hook tapes 142 of the back panel 14 are respectively fastened to the loop tapes 1212 of the side flaps 121 of the side panels 12, and then the side flaps 151 and front flap 152 of the top panel 15 are respectively and inwardly folded up, and then the end flap sections 1521 are inwardly folded up, and then the hook tapes 15211 are respectively fastened to the loop tapes 1511. After the hook tapes 15211 and the loop tapes 1511 have been respectively fastened together, the top panel 15, the side flaps 151 and the front flap 152 form a cover. After the box body 1 has been set up, the partition device 2 is put into the inside of the box body 1, and then secured to the inside of the box body 1 by fastening the respective male fastening elements (ball sides of snaps) 213 at the cardboard sheets 21 of the partition device 2 to the respective female fastening elements (socket sides of snaps) 122 at the side panels 12 of the box body 1. After installation of the collapsible lattice type partition device 2 in the box body 1, a plurality of separated open spaces are defined within the box body 1 for keeping small items.

What the invention claimed is:

1. A detachable storage box comprising a box body made by folding up a sheet element and securing the folded up sheet element in shape by hook and loop materials, said box body comprising a rectangular bottom panel having a front side and a rear side and two opposite lateral sides, a front panel and a back panel respectively extended from the front and rear sides of said rectangular bottom panel, two side panels respectively extended from the two opposite lateral sides of said bottom panel, and a top panel extended from one side of said back panel remote from said bottom panel; and a partition device mounted inside said box body and defining a plurality of open spaces for keeping small items; wherein:

said box body comprises a plurality of female fastening elements provided at its front panel, back panel and side panels at a inner side;

said partition device is comprised of a plurality of cardboard sheets connected into a lattice structure, and fastening means for securing said cardboard sheets together, said cardboard sheets having each a plurality of transverse folding lines, and two male fastening elements at both ends for fastening to the female fastening elements at the front panel and the back panel of said box body, said cardboard sheets including two outer cardboard sheets provided with male fastening elements at an outer side for fastening to the female fastening elements at the side panels of said body body.

2. The detachable storage box of claim 1, wherein said cardboard sheets have each a plurality of longitudinally spaced mounting holes; the fastening means for securing said cardboard sheets together is comprised of a plurality of split bolts for mounting in the mounting holes on said cardboard sheets, and a plurality of retainer rings for securing said split bolts to the mounting holes on said cardboard sheets.

3. The detachable storage box of claim 1, wherein said cardboard sheets have each both sides laminated with a respective flexible film material.

* * * * *